US008951944B2

(12) United States Patent
Dodd

(10) Patent No.: US 8,951,944 B2
(45) Date of Patent: Feb. 10, 2015

(54) MARINE ENGINE LUBRICATION

(71) Applicant: Infineum International Limited, Abingdon (GB)

(72) Inventor: James C. Dodd, Didcot (GB)

(73) Assignee: Infineum International Limited (GB)

( * ) Notice: Subject to any disclaimer, the term of this patent is extended or adjusted under 35 U.S.C. 154(b) by 0 days.

(21) Appl. No.: 13/776,779

(22) Filed: Feb. 26, 2013

(65) Prior Publication Data

US 2014/0182537 A1 Jul. 3, 2014

(30) Foreign Application Priority Data

Mar. 1, 2012 (EP) ..... 12157804

(51) Int. Cl.

| | |
|---|---|
| ***C10M 159/22*** | (2006.01) |
| ***F02B 43/00*** | (2006.01) |
| ***F02B 47/00*** | (2006.01) |
| ***F02M 25/00*** | (2006.01) |
| ***C10M 129/54*** | (2006.01) |
| ***C10M 169/04*** | (2006.01) |

(52) U.S. Cl.

CPC ..... *C10M 129/54* (2013.01); *C10M 169/045* (2013.01); *C10M 2203/1006* (2013.01); *C10M 2207/262* (2013.01); *C10N 2230/04* (2013.01); *C10N 2240/102* (2013.01); *C10M 2203/1025* (2013.01); *C10M 2205/0285* (2013.01)

USPC ..... 508/460; 123/1 A

(58) Field of Classification Search

CPC .... C10M 2207/262; F02B 1/04; F02B 43/10; F02B 3/06

USPC ..... 508/460; 123/1 A

See application file for complete search history.

(56) References Cited

U.S. PATENT DOCUMENTS

| | | | | |
|---|---|---|---|---|
| 7,956,022 | B2 * | 6/2011 | Le Coent et al. | 508/460 |
| 8,076,276 | B2 * | 12/2011 | Gregory | 508/460 |
| 8,609,599 | B2 * | 12/2013 | Hartley | 508/584 |
| 2002/0183212 | A1 * | 12/2002 | Hammond et al. | 508/460 |
| 2009/0291868 | A1 * | 11/2009 | Dodd et al. | 508/460 |
| 2010/0062957 | A1 | 3/2010 | Bertram et al. | |

FOREIGN PATENT DOCUMENTS

| | | | |
|---|---|---|---|
| EP | 2123740 | A1 | 11/2009 |
| WO | WO-2010/115594 | A1 | 10/2010 |

* cited by examiner

*Primary Examiner* — Vishal Vasisth

(57) ABSTRACT

A lubricant additive comprising an overbased metal hydrocarbyl-substituted hydroxybenzoate detergent dispersed in a diluent comprising 10 mass % or more of a basestock containing greater than or equal to 90% saturates and less than or equal to 0.03% sulphur is blended, in a minor amount, with an oil of lubricating viscosity, in a major amount, to give a trunk piston marine engine lubricating oil composition for a medium-speed four-stroke compression-ignited marine engine.

8 Claims, No Drawings

MARINE ENGINE LUBRICATION

FIELD OF THE INVENTION

This invention relates to trunk piston marine engine lubrication for a medium-speed four-stroke compression-ignited (diesel) marine engine.

BACKGROUND OF THE INVENTION

Marine trunk piston engines generally use Heavy Fuel Oil ('HFO') for offshore running. Heavy Fuel Oil is the heaviest fraction of petroleum distillate and comprises a complex mixture of molecules including up to 15% of asphaltenes, defined as the fraction of petroleum distillate that is insoluble in an excess of aliphatic hydrocarbon (e.g. heptane) but which is soluble in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer which can result in the formation of cracks that then propagate through the piston. If a crack travels through the piston, hot combustion gases can enter the crankcase, possibly resulting in a crankcase explosion.

It is therefore highly desirable that trunk piston engine oils ('TPEO's) prevent or inhibit asphaltene precipitation. The prior art describes ways of doing this, including use of metal carboxylate detergents.

U.S. Pat. No. 7,053,027 describes use of one or more overbased metal carboxylate detergents in combination with an antiwear additive in a dispersant-free TPEO.

The problem of asphaltene precipitation is more acute at higher basestock saturate levels and WO 2008/128656 describes a solution by use of an overbased metal hydrocarbyl-substituted hydroxybenzoate detergent having a basicity index of less than 2 and a degree of carbonation of 80% or greater in a marine trunk piston engine lubricant to reduce asphaltene precipitation in the lubricant. Mentioned, but not exemplified, are lubricants comprising Group III and Group IV basestocks, and exemplified are lubricants comprising a Group II basestock, all of which basestocks have high saturates levels.

The art does not, however, concern itself with the influence of the diluent present in the metal carboxylate detergent. Although US-A-2007/0027057 describes alkylhydroxybenzoate additives made with a Group II diluent oil (see paragraph 0174), it is concerned with provision of a low sulphur content, not use in a TPEO to control asphaltene dispercancy.

SUMMARY OF THE INVENTION

It is now surprisingly found that, when the diluent oil in a hydroxybenzoate detergent has greater than or equal to 90% saturates and less than or equal to 0.03% sulphur, a TPEO made therefrom has improved asphaltene dispersancy performance, irrespective of the nature of the lubricating oil in the TPEO. Such a composition may also be useful in the lubrication of the crankcase of a marine crosshead engine, i.e. as a system lubricant.

Thus, a first aspect of the invention is a method of preparing a trunk piston marine engine lubricating oil composition for a medium-speed four-stroke compression-ignited marine engine comprising blending (A) a lubricant additive, in a minor amount, comprising an overbased metal hydrocarbyl-substituted hydroxybenzoate detergent dispersed in diluent comprising 10 mass % or more of a basestock containing greater than or equal to 90% saturates and less than or equal to 0.03% sulphur, the additive having a basicity index in the range of 1 to 8; with (B) an oil of lubricating viscosity in a major amount.

A second aspect of the invention is a trunk piston marine engine lubricating oil composition for a medium-speed four-stroke compression-ignited marine engine obtainable by the method of the first aspect of the invention.

A third aspect of the invention is the use of a lubricant additive as defined in the first aspect of the invention in a trunk piston marine lubricating oil composition for a medium-speed compression-ignited marine engine to improve, or provide similar, asphaltene-handling during operation of said engine, fueled by a heavy-fuel oil, and its lubrication by the composition, in comparison with analogous operation when the additive diluent is a Group I basestock.

A fourth aspect of the invention is a method of operating a trunk piston medium-speed compression-ignited marine engine comprising (i) making a lubricating oil composition by the method of the first aspect of the invention;
(ii) fueling the engine with a heavy fuel oil; and
(iii) lubricating the crankcase of the engine with said lubricating oil composition.

A fifth aspect of the invention is a lubricant additive comprising an overbased metal hydrocarbyl-substituted hydroxybenzoate detergent dispersed in diluent comprising 10 mass % or more of a basestock containing greater than or equal to 90% saturates and less than or equal to 0.03% sulphur, the additive having a basicity index of from 3 or from greater than 3, to 8 or to 7 or to 6.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 or more mass % of a composition;

"minor amount" means less than 50 mass % of a composition;

"TBN" means total base number as measured by ASTM D2896.

Furthermore in this specification:

"calcium content" is as measured by ASTM 4951;
"phosphorus content" is as measured by ASTM D5185;
"sulphated ash content" is as measured by ASTM D874;
"sulphur content" is as measured by ASTM D2622;
"KY100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention in its various aspects, if and where applicable, will now be discussed in more detail below.

Oil of Lubricating Viscosity

The lubricating oils may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., caster oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention embraces all of the above basestocks constituting the oil of lubricating viscosity and also basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil.

Preferably, the oil of lubricating viscosity in this invention contains 50 mass % or more of a Group I or Group II basestock or a mixture thereof. It may contain 60, such as 70, 80 or 90, mass % or more of said basestock or a mixture thereof. The oil of lubricating viscosity may be substantially all of said basestock or a mixture thereof.

Overbased Metal Detergent Additive (A)

A metal detergent is an additive based on so-called metal "soaps", that is metal salts of acidic organic compounds, sometimes referred to as surfactants. They generally comprise a polar head with a long hydrophobic tail. Overbased metal detergents, which comprise neutralized metal detergents as the outer layer of a metal base (e.g. carbonate) micelle, may be provided by including large amounts of metal base by reacting an excess of a metal base, such as an oxide or hydroxide, with an acidic gas such as carbon dioxide.

In the present invention, overbased metal detergents (A) are overbased metal hydrocarbyl-substituted hydroxybenzoates, preferably hydrocarbyl-substituted salicylate, detergents.

"Hydrocarbyl" means a group or radical that contains carbon and hydrogen atoms and that is bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl. The overbased metal hydrocarbyl-substituted hydroxybenzoate typically has the structure shown:

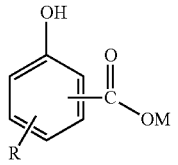

wherein R is a linear or branched aliphatic hydrocarbyl group, and more preferably an alkyl group, including straight- or branched-chain alkyl groups. There may be more than one R group attached to the benzene ring. M is an alkali metal (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group. When M is polyvalent, it is represented fractionally in the above formula.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term 'low-based' is used to describe metal detergents in which the equivalent ratio of metal moiety to acid moiety is greater than 1, and up to about 2.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole % of the cations in the oil-insoluble metal salt are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may be expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). In this invention, Basicity Index is used. Basicity Index is the molar ratio of total base to total soap in the overbased detergent. The Basicity Index of the detergent (A) in the invention is preferably in the range of 1 to 8, more preferably 3 to 8, such as 3 to 7, such as 3 to 6. The Basicity Index may for example be greater than 3.

Overbased metal hydrocarbyl-substituted hydroxybenzoates can be prepared by any of the techniques employed in the art. A general method is as follows:

1. Neutralisation of hydrocarbyl-substituted hydroxybenzoic acid with a molar excess of metallic base to produce a slightly overbased metal hydrocarbyl-substituted hydroxybenzoate complex, in a solvent mixture consisting of a volatile hydrocarbon, an alcohol and water;
2. Carbonation to produce colloidally-dispersed metal carbonate followed by a post-reaction period;
3. Removal of residual solids that are not colloidally dispersed; and
4. Stripping to remove process solvents.

Overbased metal hydrocarbyl-substituted hydroxybenzoates can be made by either a batch or a continuous overbasing process.

Metal base (e.g. metal hydroxide, metal oxide or metal alkoxide), preferably lime (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may by effected in one or more stages over a range of temperatures up to the reflux temperature of the alcohol promoters. Addition temperatures may be similar, or different, or may vary during each addition stage. Phases in which temperatures are raised, and optionally then reduced, may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 $mm^2$/sec at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are used as a diluent (or oil) dispersion. If the reaction mixture contains insufficient oil to retain an oil solution after removal of the volatiles, further oil should be added. This may occur before, or at an intermediate point, or after solvent removal.

In this invention, the diluent used comprises a basestock containing greater than or equal to 90% saturates and less than or equal to 0.03% sulphur. The product may contain up to 20, 30, 40, 50, 60, 70, 80 or 90, mass % or more (such as all) of said basestock. An example of said basestock is a Group II basestock.

The treat rate of additive (A) contained in the lubricating oil composition may for example be in the range of 1 to 2.5, preferably 2 to 20, more preferably 5 to 18, mass %.

Co-Additives

The lubricating oil composition of the invention may comprise further additives, different from and additional to (A). Such additional additives may, for example include ashless dispersants, other metal detergents, anti-wear agents such as zinc dihydrocarbyl dithiophosphates, anti-oxidants and demulsifiers.

It may be desirable, although not essential, to prepare one or more additive packages or concentrates comprising the additives, whereby additive (A) can be added simultaneously to the oil of lubricating viscosity (B) to form the lubricating oil composition. Dissolution of the additive package(s) into the oil of lubricating viscosity may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of oil of lubricating viscosity (B). Thus, additive (A), in accordance with the present invention, may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations, as a trunk piston engine oil may typically contain 30, preferably 10 to 28, more preferably 12 to 24, mass % of the additive package(s), the remainder being base oil. Preferably, the trunk piston engine oil has a compositional TBN (using ASTM D2896) of 20 to 60, such as 25 to 55. There may be mentioned a trunk piston engine oil where the oil of lubricating viscosity thereof comprises 50, or 60, or 70, or 80, or 90, mass % or more of a basestock containing greater than or equal to 90% saturates and less than or equal to 0.03% sulphur. It may contain all or substantially all of said basestock.

EXAMPLES

The present invention is illustrated by but in no way limited to the following examples.

Components

The following components and oils were used:

Component (A):

(A1) a set of high overbased calcium salicylate detergents each having a basicity index of 6.0 where the diluents were respectively SN 150 (Group I, as a reference), and the following Group II basestocks: Star 5 and Jurong 150.

(A2) a set of high overbased calcium salicylate detergents each having a basicity index of 7.8, where the diluents were the same as in (A1).

(A3) a set of high overbased calcium salicylate detergents each comprising a mixture of (A1) and (A4) (0.41:0.59) and having a basicity index of 5.8, where the diluents were the same as in (A1).

(A4) a set of medium overbased calcium salicylate detergents each having a basicity index of 3.0, where the diluents were the same as in (A1).

(A1) to (A4) were made by solvent exchange between the solvent present in production (e.g. xylene) and the above-mentioned diluents.

Component (B):

a heavy fuel oil, ISO-F-RMK 380

Oils of Lubricating Viscosity:

Oil I: an API Group I base oil known as XOM 600

Oil II: an API Group II 600R basestock from Chevron

Lubricants

Selections of the above components were blended with a major proportion of oil of lubricating viscosity to give a range of trunk piston marine engine lubricants. Some of the lubricants are examples of the invention; others are reference examples for comparison purposes. The compositions of the lubricants tested when each contained HFO are shown in the tables below under the "Results" heading. All lubricants tested had a TBN of 30.

Testing

Light Scattering

The test lubricants were evaluated for asphaltene dispersancy using light scattering according to the Focused Beam Reflectance Method ("FBRM"), which predicts asphaltene agglomeration and hence 'black sludge' formation.

The FBRM test method was disclosed at the $7^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on base stocks containing greater than or less than 90% saturates, and greater than or less than 0.03% sulphur. The predictions of relative performance obtained from FBRM were confirmed by engine tests in marine diesel engines.

The FBRM probe contains fibre optic cables through which laser light travels to reach the probe tip. At the tip, an optic focuses the laser light to a small spot. The optic is rotated so that the focussed beam scans a circular path between the window of the probe and the sample. As particles flow past the window they intersect the scanning path, giving backscattered light from the individual particles.

The scanning laser beam travels much faster than the particles; this means that the particles are effectively stationary. As the focussed beam reaches one edge of the particle there is an increase in the amount of backscattered light; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The test lubricant formulations were heated to 60° C. and stirred at 400 rpm; when the temperature reached 60° C. the FBRM probe was inserted into the sample and measurements made for 15 minutes. An aliquot of heavy fuel oil (10% w/w) was introduced into the lubricant formulation under stirring using a four blade stirrer (at 400 rpm). A value for the average counts per second was taken when the count rate had reached an equilibrium value (typically overnight).

Results

Light Scattering

Results of the FBRM tests are summarized in the tables below (TABLES 1 and 2).

The detergents were of the (A1), (A2) and (A3) types in Table 1 and of the (A1), (A2), (A3) and (A4) types in Table 2. In Table 1 the oil of lubricating viscosity was Oil I, i.e. a Group I oil; in Table 2, the oil of lubricating viscosity was Oil II, i.e. a Group II oil.

The mass % Ca and diluent in the final TPEO's arising from use of the four detergent types are summarised below.

| | % Ca | % Diluent |
|---|---|---|
| (A1) | 1.07 | 2.83 |
| (A2) | 1.07 | 3.43 |
| (A3) | 1.06 | 4.52 |
| (A4) | 1.07 | 4 |

TABLE 1

| | | Detergent | | |
|---|---|---|---|---|
| Example | Diluent | (A1) | (A2) | (A3) |
| 1[1] | SN 150 | 3,628.65 | 8,365.56 | 1,122.53 |
| | | 1.00 | 1.00 | 1.00 |
| 1.1 | Star 5 | 3,636.75 | 8,099.94 | 1,371.73 |
| | | 1.00 | 0.97 | 1.22 |
| 1.2 | Jurung 150 | 2,474.09 | 6,735.97 | 1,117.78 |
| | | 0.68 | 0.81 | 1.00 |

The results are given in particle counts (where a lower value indicates a better performance). Below each value is a normalized number where 1.00 is taken for the reference examples (Examples 1[1]). Examples 1.1 and 1.2 are examples of the invention.

The results compare the performance of detergents in high saturate diluents (Examples 1.1, 1.2) against detergents in a low saturate diluent (Example 1[1]), all in a low saturate 600 N lubricating oil basestock. Examples 1.1 and 1.2 are shown to exhibit similar or improved performance.

TABLE 2

| | | Detergent | | | |
|---|---|---|---|---|---|
| Example | Diluent | (A1) | (A2) | (A3) | (A4) |
| 2[1] | SN 150 | 7,278.37 | 7,404.61 | 2,733.31 | 4,030.76 |
| | | 1.00 | 1.00 | 1.00 | 1.00 |
| 2.1 | Star 5 | 4,991.48 | 7,370.07 | 2,267.94 | 1,264.75 |
| | | 0.69 | 0.99 | 0.83 | 0.31 |
| 2.2 | Jurung 150 | 3,076.14 | 7,691.11 | 1,533.98 | 1,711.76 |
| | | 0.42 | 1.04 | 0.56 | 0.42 |

Results are given as in Table 1, but wherein Examples 2[1] are the reference examples, and Examples 2.1 and 2.2 are examples of the invention.

The results compare the performance of detergents in high saturate diluents (Examples 2.1, 2.2) against detergents in a low saturate diluent (Example 2[1]), all in a high saturate 600 N lubricating oil basestock. Examples 2.1 and 2.2 are shown to exhibit similar or improved performance.

What is claimed is:

1. A method of preparing a trunk piston marine engine lubricating oil composition for a medium-speed four-stroke compression-ignited marine engine having a TBN of 20 to 60 mg KOH/g, said method comprising blending (A) detergent additive, in a minor amount, consisting essentially of overbased metal hydrocarbyl-substituted hydroxybenzoate detergent dispersed in diluent basestock containing greater than or equal to 90% saturates and less than or equal to 0.03% sulphur, the detergent additive having a basicity index in the range of 3 to 6; with (B) an oil of lubricating viscosity containing greater than or equal to 90% saturates and less than or equal to 0.03% sulphur, in a major amount.

2. The method of claim 1 wherein the metal is calcium.

3. The method of claim 1 wherein the hydrocarbyl-substituted hydroxybenzoate is a salicylate.

4. The method of claim 1 wherein the hydrocarbyl group has from 8 to 400 carbon atoms.

5. The method of claim 4 wherein the hydrocarbyl group has from 16 to 64 carbon atoms.

6. The method of claim 1 wherein the composition has a TBN of 25 to 55 mg KOH/g.

7. A trunk piston marine engine lubricating oil composition for a medium-speed four-stroke compression-ignited marine engine obtained by the method of claim 1.

8. A method of operating a trunk piston medium-speed compression-ignited marine engine comprising:

(i) making a lubricating oil composition by the method of claim 1;

(ii) fuelling the engine with a heavy fuel oil; and (iii) lubricating the crankcase of the engine with said lubricating oil composition.

* * * * *